US005810411A

United States Patent [19]

Major

[11] Patent Number: 5,810,411

[45] Date of Patent: Sep. 22, 1998

[54] TRAINING DEVICE FOR USING CHOPSTICKS

[76] Inventor: Mark L. Major, 11 Cheltenham Way, San Jose, Calif. 95139

[21] Appl. No.: 950,381

[22] Filed: Oct. 14, 1997

[51] Int. Cl.[6] ..... A47G 21/10; A47J 43/28

[52] U.S. Cl. ..... 294/99.2; 294/1.1

[58] Field of Search ..... 294/1.1, 16, 19.1, 294/33, 99.2; 16/115; 24/462, 499, 500, 530; 30/142, 150, 322; D7/642, 645, 686

[56] References Cited

U.S. PATENT DOCUMENTS

| | | | |
|---|---|---|---|
| D. 343,096 | 1/1994 | Lachapelle | D7/642 |
| D. 368,208 | 3/1996 | Lachapelle | D7/642 |
| D. 368,413 | 4/1996 | Lowenfels | D7/653 |
| D. 374,379 | 10/1996 | Jee et al. | D7/642 |
| 3,264,909 | 8/1966 | Block | 294/99.2 |
| 3,323,825 | 6/1967 | Arima | 294/99.2 |
| 3,414,310 | 12/1968 | Ono | 294/99.2 X |
| 3,501,191 | 3/1970 | Darr | 294/99.2 |
| 3,637,248 | 1/1972 | Arita | 294/16 |
| 3,807,781 | 4/1974 | Rollband | 294/16 |
| 3,892,435 | 7/1975 | Huey | 294/16 |
| 4,199,180 | 4/1980 | Kelly | 294/33 |
| 4,576,408 | 3/1986 | Maneki | 294/99.2 |
| 4,659,128 | 4/1987 | Dong | 294/99.2 |
| 4,721,334 | 1/1988 | Nakatsu | 294/99.2 |
| 4,787,663 | 11/1988 | Laramie | 294/99.2 |
| 4,809,435 | 3/1989 | Printz | 30/142 |
| 5,431,465 | 7/1995 | Shibata | 294/1.1 |
| 5,486,029 | 1/1996 | Kobayashi | 294/99.2 |
| 5,611,586 | 3/1997 | Kang | 294/99.2 |

*Primary Examiner*—Johnny D. Cherry
*Attorney, Agent, or Firm*—Thomas Schneck; John P. McGuire, Jr.

[57] ABSTRACT

A training device for using chopsticks has a pair of parallel, spaced apart plates supported at the edges of the plates by a U-shaped spacer. Two L-shaped members are arranged in a back-to-back configuration and are attached at an edge of the plates, extending into the area between the two plates. The two upright portions of the L-shaped members are flexible and are shaped to support a chopstick. A flexible arm extends from the open end of the U-shaped spacer at an angle toward each upright portion. Once two chopsticks are inserted, the arm holds the chopsticks against the upright portion. Pressure against the edges of the chopsticks causes the arm and upright portion to flex and the tips of the chopsticks to be brought together. A number of features can be included, such as attaching a magnet or suction cup to one plate, printing one plate, or attaching a ring to the edge of the device to act as a key ring. In an alternate embodiment, the holder is associated with collapsible chopsticks. The collapsible chopsticks are comprised of a number of tubular sections that fit within each other and are held against each other when the chopstick is extended to its full length.

19 Claims, 3 Drawing Sheets

TRAINING DEVICE FOR USING CHOPSTICKS

FIELD OF THE INVENTION

This invention relates to a training device for using chopsticks.

BACKGROUND OF THE INVENTION

Chopsticks, widely used throughout Asia as an eating utensil, are often considered a novelty by those who are unfamiliar with their use. Chopsticks can be made of wood, plastic, or metal. Plastic and metal chopsticks have the advantage of being readily washable and reusable, while wooden chopsticks are more traditional and have a superior texture for gripping food.

People who are unfamiliar with chopsticks can find these utensils difficult to use. Asian restaurants have sought methods to introduce chopsticks to the public in a manner that is inexpensive and makes the use of chopsticks less daunting. Additionally, restaurants and food suppliers would find added value if a device for using chopsticks also had some novelty entertainment value.

A number of devices have been proposed to simplify the use of chopsticks. Disclosed in U.S. Pat. No. 3,892,435 and Design U.S. Pat. No. 374,379 are devices that construct the pair of chopsticks as a single unit with a continuous flexible member connecting the individual chopsticks. This limits the manufacture of the device to plastic material.

Some devices for aiding in the use of chopsticks are spring-type devices into which a pair of chopsticks is inserted. U.S. Pat. No. 4,576,408 and U.S. Pat. No. 4,199,180 illustrate one possible spring type device that uses a split resilient ring into which the chopsticks would be inserted. The ring is able to flex when pressure is applied to the edges of the chopsticks, bringing the tips of the chopsticks closer together.

Another group of spring type chopstick holders employ a flexible bridge connected between two receiving slots. U.S. Pat. No. 3,637,248, U.S. Pat. No. 4,721,334 and U.S. Pat. No. 4,787,663 each describe devices where two sleeves are used to frictionally hold two chopsticks. A flexible bridge connects the two sleeves. When pressure is applied to the outer edges of the chopsticks, the bridge will flex, and the tips of the chopsticks will be brought together.

U.S. Pat. No. 4,659,128 describes a variation of this type of device. This device is comprised of a pair of sleeves for frictionally holding the chopsticks connected by an upper and a lower bridge. The upper bridge is flexible and the lower bridge is a crimped tube that will collapse to a more compact state as the ends of the chopsticks are brought together. The patent also describes attaching an advertising indicia to the upper bridge of the chopstick holder.

Some of the devices for aiding in the use of chopsticks use a hinge rather than a spring. U.S. Pat. No. 3,807,781 describes a device where a first chopstick is attached to one edge of a triangular shaped plate, and a second chopstick is pivotally attached to a second edge of the plate. A second similar device is seen in U.S. Pat. No. 5,486,029 which describes a tube which is divided into three sections by two transverse cuts that cut partially through the tube. The tube is bent at the two cuts, and the chopsticks are inserted into the two sections of tube that are bent downward. The tube sections then pivot on the central section of tubing to which they are attached, allowing the tips of the chopsticks to be brought together.

In addition to seeking devices to make chopsticks easier to use, some chopstick users seek to make chopsticks more portable. By having chopsticks that can conform to a reduced size, the chopsticks are easier to include in a take-out container or with packaged foods. The chopsticks are also easier to carry in a pocket or purse.

A pair of patents describe telescoping utensils, although not in connection with a device to aid in the use of chopsticks. Design U.S. Pat. No. 368,413 shows a fork with a telescoping handle that can be extended to a full length or retracted to a compact length. U.S. Pat. No. 5,431,465 describes a collapsible chopstick designed in two parts. A broader hollow holding member holds within it a solid tip portion. The tip is held at a tapered orifice of the holding member and locks in place at this orifice end. The opposite end of the holding member contains a removable cap enabling the tip to be removed and cleaned or replaced.

It is an object of this invention to provide a training device for using chopsticks that is simple in design, inexpensive to produce, and easy to use.

It is another object of this invention to have a chopstick device adaptable as a novelty promotional item.

SUMMARY OF THE INVENTION

The above objects of the invention are accomplished by having a chopstick holder comprising a front and a back face plate, separated by a spacer that is attached to the edges of the face plates. Between the two face plates and attached to the edge of each plate is a flexible receptor for the chopsticks. This flexible receptor is shaped like two "L"s in opposite, back-to-back, orientation with the horizontal section of the L shaped leg having a lip that would hold the ends of the chopsticks. The flexible member would be secured only at the edge of the face plates, allowing the vertical lengths of the L to flex. Thus, by applying pressure to the outer surfaces of the chopsticks the tips of the chopsticks would be brought together. Also attached to the edge of the face plates are two flexible arms that extend at an angle into the interior of the device toward the flexible L shaped members. When the chopsticks are inserted into the holder, these arms will flex to hold the chopsticks securely against the first L shaped legs. In one embodiment, the arms have a frictional means to prevent the chopsticks from slipping, such as a surface touching the chopsticks that is textured or made of rubber.

Additional features can be added to this basic holder to increase the value of the holder as a novelty item. These features include adding a ring to a face plate of the holder to allow for attachment to a key ring, adding printing to the front face of the holder, and/or enabling the holder to be secured to a surface by adding a magnet or suction cup to the back face plate. It is also possible to adapt the face of the device to act as a rest for the chopsticks such that when the device is placed face up on a table the chopsticks could be placed on the device to prevent the chopsticks from touching the table.

The basic holder is adapted to work with different types of chopsticks. In one embodiment, included with the holder is a set of telescoping chopsticks. The chopsticks would have a tapering solid tip section, one or more tapering hollow outer sections of sufficient width at the narrower end to prevent passage of the larger end of the tip section and sufficiently wide at the wider end to allow the previous tapering telescopic section to enter. The telescoping chopstick would have a final tapering hollow base section that would hold the other sections within it when collapsed and would constrain the other sections when extended. The base section would have a cap at its end. The front section could be made of wood, plastic, or metal and the tubular sections could be made of metal or plastic.

BEST MODE FOR CARRYING OUT THE INVENTION

Figure 1:
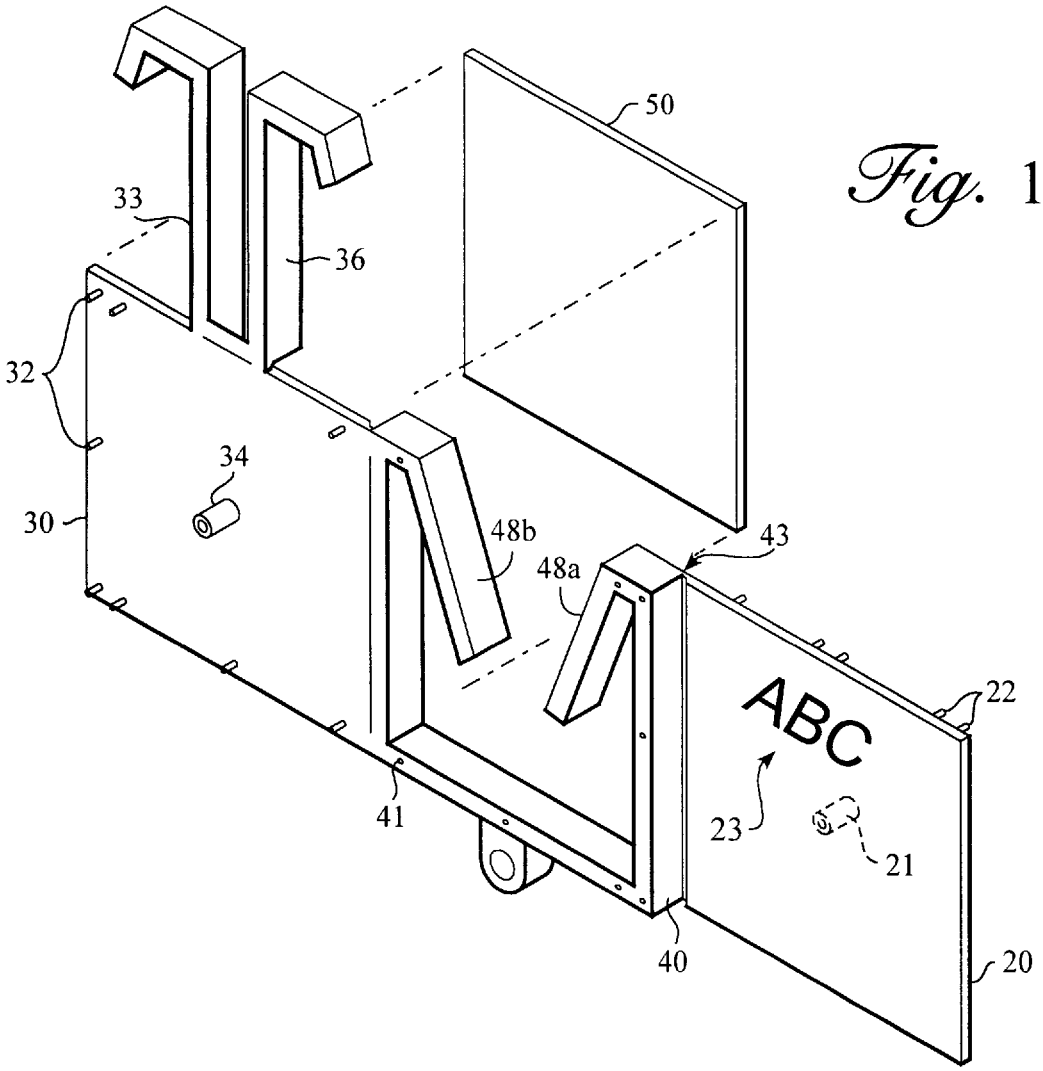
FIG. 1 is a view of the unassembled chopstick holder apparatus of the present invention.

With reference to FIG. 1, the holder apparatus of the present invention is manufactured as a single plastic unit that could be rapidly assembled. In this embodiment, the front face plate 20 has molded plastic plugs 22 that insert into holes 43 on spacer 40. Front face plate 20 is hingedly attached on one side to one edge of spacer 40 and is assembled by folding over front face plate 20 onto spacer 40 at a hinge line and mating plugs 22 with holes 43. Spacer 40 will then extend along three sides of front face plate 20 and be attached to these three sides. Next, the L-shaped leg pieces 33 and 36 are folded over to fit against back face plate 30. Back face plate 30 is then folded over to fit onto spacer 40 at its hinge line with the molded plastic plugs 32 fitting into holes 41. In the center of back face plate 30 is receiving fitting 34 that is frictionally fitted onto mating knob 21 to securely fit front face plate 20 together to back face plate 30. With the front face plate 20 and the back face plate 30 both attached on three sides to spacer 40, the area between the plates will define a cavity. Contiguous with spacer 40 are two flexible arms 48*a* and 48*b* that extend at opposing angles into the interior of the cavity defined by front face plate 20 and back face plate 30. Arms 48*a* and 48*b* are not affixed to front face plate 20 or to back face plate 30. Legs 33 and 36 also extend into the interior of the cavity, with arms 48*a* and 48*b* extending at an angle towards legs 33 and 36.

Figure 2A:
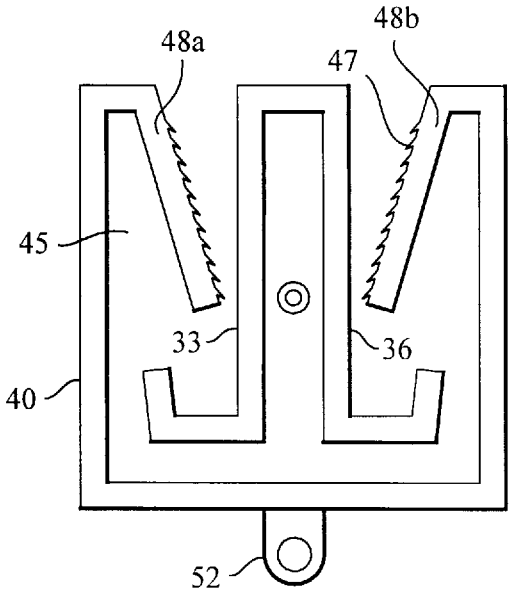
FIG. 2A is a top plan view of the interior of an assembled holder shown in FIG. 1.

In FIG. 2A, spacer 40 is shown defining the usually U-shaped perimeter of three sides of the chopstick holder. The U-shaped spacer has inwardly extending ends 48*a* and 48*b*, which are resilient arms facing the L-shaped legs 33 and 36. Arms 48*a* and 48*b* extend into cavity 45 defined by spacer 40. Arms 48*a* and 48*b* can have texturing 47. Texturing 47 can be effected by either use of a material, such as rubber, or by shape, such as ridges.

Figure 2B:
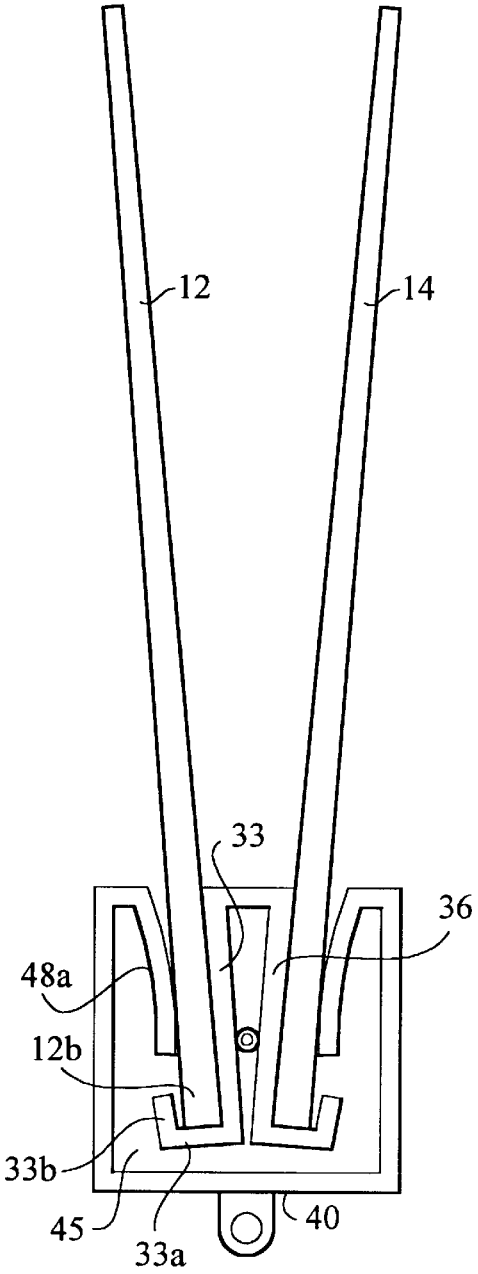
FIG. 2B depicts the holder of FIG. 2A with chopsticks inserted.

In FIG. 2B, one edge of chopstick 12 rests against leg 33 with the end 12*b* of the chopstick 12 resting against the horizontal end 33*a* of leg 33. End 12*b* is prevented from slipping into cavity 45 by lip 33*b* of leg 33. Inserting chopstick 12 against leg 33 will press back arm 48*a*, holding the chopstick in place. This will be true regardless of whether the chopstick is circular or square. In addition, the material that the chopstick is made of, be it wood, metal, or plastic, will not affect the functioning of the device. The second chopstick 14 will be held against leg 36 in the same manner as chopstick 12 is held against leg 33.

Figure 2C:
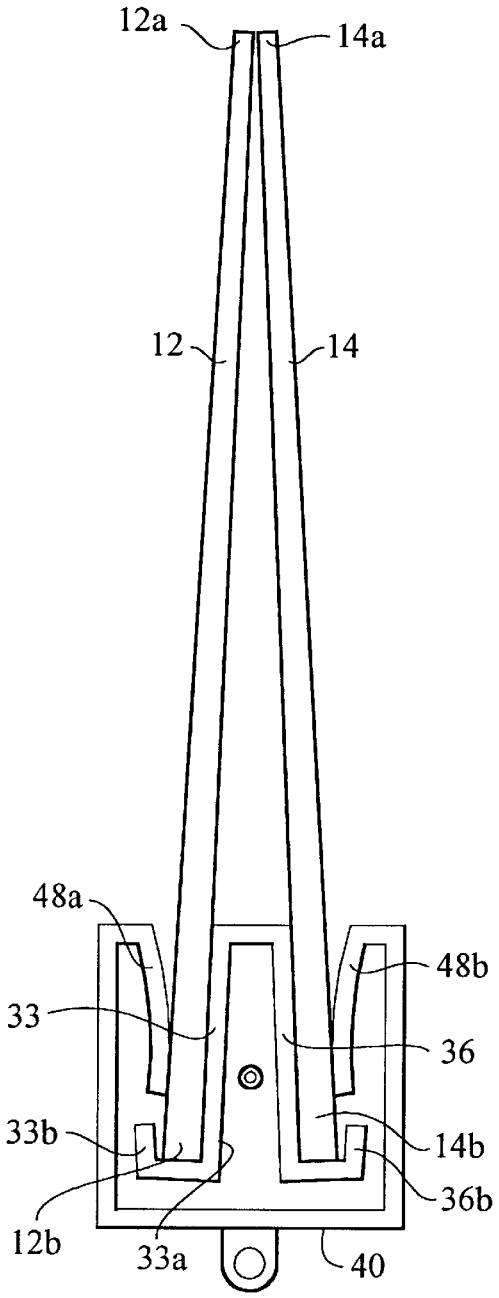
FIG. 2C depicts the holder shown in FIG. 2B with the tips of the chopsticks having been brought together.

In FIG. 2C, pressure is applied to the sides of the chopsticks 12 and 14. Arms 48*a* and 48*b* press against the edges of chopsticks 12 and 14, bringing arms 48*a* and 48*b* closer to the sides of spacer 40. The ends 12*b* and 14*b* of chopsticks 12 and 14 will also press against lips 33*b* and 36*b* of legs 33 and 36, which will then move apart. The chopstick tips 12*a* and 14*a* are then brought closer together. A piece of food located between 12*a* and 14*a* could then be grasped.

A number of different features can be added to this device to add entertainment value or to allow sales as a novelty item. The front face plate 20 can be clear to allow viewing of the inner workings of the mechanisms of the chopstick holder. Alternatively, writing 23 could be included on front face plate 20 to allow for advertising or decoration of the holder. Additionally, the front face plate can be shaped into a raised design. Having two side edges of the front face plate 20 raised compared to the non-raised central portion of front face plate 20 enables the chopstick holder to be placed flat on the back face plate 30. The chopsticks then can be removed from the holder and placed on the front face plate. This will prevent the tips of the chopsticks from coming into contact with the table if they are not in use.

Another feature that can be included in the device is a mechanical device to allow the chopstick holder to be temporarily attached to a surface. FIG. 1 shows a magnet 50 that is affixed to back face plate 30 with epoxy that would allow the holder to be attached to a metal surface such as a refrigerator. Alternatively, other attachment means, such as a suction cup, could be used.

Another feature, seen in FIG. 2A, is inclusion of a key ring mount 52 for attaching a key chain to the chopstick holder. Key ring mount 52 is placed on spacer 40 on the side opposite to the side that receives the chopsticks.

Figure 3A:
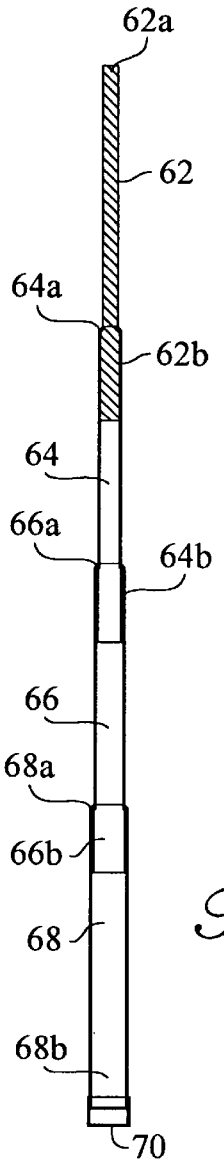
FIG. 3A depicts an expanded collapsible chopstick for use with the apparatus of FIG. 1.

The collapsible chopstick shown in FIG. 3A is comprised of a tip portion 62. This can be made of wood, plastic or metal, can be hollow or solid, and could even be disposable. The tip portion 62 is broader at a base end 62*b* than at the top end 62*a*. Tip portion 62 is inserted into first tube 64. First tube 64 has a slight lip 64*a* that holds the slightly broader base 62*b* of tip 62. First tube 64 in turn has a slightly broader base 64*b* that is held against the lip 66*a* of second tube 66. Second tube 66 in turn has a broader base section 66*b* that is held when extended against lip 68*a* of third tube 68. Base 68*b* of third tube section 68 is capped by a cap 70.

Figure 3B:
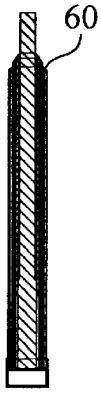
FIG. 3B depicts the chopstick of FIG. 3A collapsed.

FIG. 3B shows the collapsed view of collapsible chopstick 60. In the collapsed form, the collapsible chopstick 60 can fit into the chopstick holder 80 with only a minimal amount of the chopstick protruding from the holder.

Figure 3C:
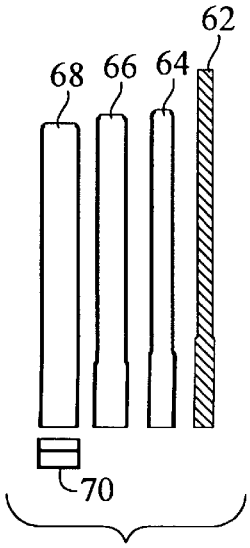
FIG. 3C depicts the chopstick of FIG. 3A disassembled.

FIG. 3C shows collapsible chopstick 60 with the component part separated by removing cap 70 and taking tip portion 62 and tubular portion 64, 66, and 68 apart. Doing so allows for easy cleaning of the device as well as substitution for different types of chopstick tips 62.

Figure 4A:
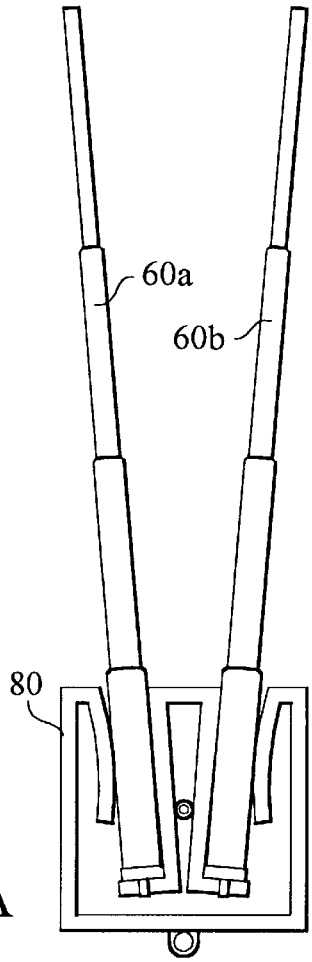
FIG. 4A shows the chopstick of FIG. 3A inserted into the chopstick holder apparatus of FIG. 2A.
Figure 4B:
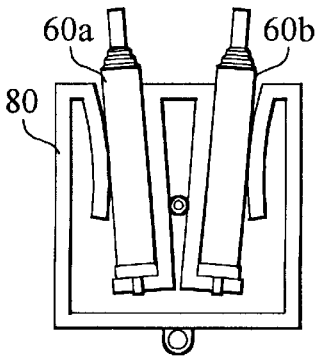
FIG. 4B is the holder apparatus and chopsticks seen in FIG. 4A with the collapsible chopsticks in a collapsed position.

In a second embodiment of the device shown in FIGS. 4A and 4B, the chopstick holder 80 includes a pair of collapsible chopsticks 60*a* and 60*b*. This enables the device to be employed as a small and convenient way of carrying portable chopsticks. FIG. 4A depicts the collapsible chopsticks 60*a* and 60*b* held in chopstick holder 80. The chopsticks may be permanently mounted therein so that the collapsible chopsticks and holder may be sold as a unit. FIG. 4B shows chopstick holder 80 with chopsticks 60*a* and 60*b* in a collapsed position.

I claim:

1. A training device for using chopsticks having a small end for grasping food and a large end opposite the small end comprising:

a pair of back-to-back L-shaped members, each member having a horizontal dimension seating the large end of a chopstick; and a U-shaped member surrounding the L-shaped members, the U-shaped member having resilient ends turned inwardly facing the L-shaped members, providing bias against chopsticks inserted between the L-shaped members and the resilient ends of the U-shaped members.

2. The device of claim 1 wherein the back-to-back L-shaped members have an upright dimension at right angles to the horizontal dimension, with the upright dimension of the two L-shaped members joined distal to the horizontal dimension.

3. The device of claim 1 wherein said resilient ends are curved.

4. The device of claim 1 wherein said resilient ends are straight.

5. The device of claim 1 wherein said resilient ends are textured.

6. The device of claim 1 further comprising front and back face plates sandwiching the U-shaped member therebetween.

7. The device of claim 6 wherein the U-shaped member has a thickness defining upper and lower planes, one of the front and back face plates connected to a side of the U-shaped member in the upper plane and the other of the front and back face plates connected to an opposite side of the U-shaped member in the lower plane, the connections between the face plates and U-shaped member being hinges, allowing folding of the face plates over the U-shaped member.

8. The device of claim 6 further comprising a magnetic plate joined to one of the front and back face plates.

9. The device of claim 1 wherein a pair of telescoping chopsticks is mounted in the L-shaped members.

10. The device of claim 9 wherein the chopsticks are permanently mounted in the L-shaped members.

11. A training device for using chopsticks comprising:

a front face plate;

a back face plate;

a spacer connected at a first side of said spacer to an edge of said front face plate and connected at a second side of said spacer to an edge of said back face plate, such that an interior space is defined between said face plates; and a pair of resilient chopstick receiving members affixed at an edge of said front face plate and said back face plate extending into the interior of said interior space, said receiving members partially attached to at least one of said front and back face plates such that when force is applied to the outer edges of a pair of chopsticks inserted into said receiving members, the tips of the chopsticks are brought closer together and when force is removed, the tips of the chopsticks will move further apart.

12. The device of claim 11 further comprising:

a ring mounted on an exterior edge of said device for securing said device to a key ring.

13. The device of claim 11 wherein the front face plate contains printing.

14. The device of claim 11 wherein the resilient chopstick receiving members constitute two flexible L-shaped legs in opposite orientation, wherein a shorter bottom section of the legs has a lip for holding said chopsticks in place, and further comprising a flexible pair of arms extending at an angle from the edge of said face plates toward said flexible legs for securely holding said chopsticks.

15. The device of claim 14 wherein said flexible arms have a gripping means for preventing said chopsticks from sliding.

16. The device of claim 11 further comprising:

a pair of telescoping chopsticks inserted into said receiving members, said telescoping chopsticks comprising, a plurality of hollow tubular sections of succeedingly wider inner bore wherein each section has a first end and a second end, said second end being slightly wider than said first end and said first end having a lip for holding said second wider end such that the sections could be collapsed with each section fitting within the broader bore of the succeeding outer section and could also be extended to a full length with said wider second end of each section held against said lip of said first end of each section;

a tip section with a first end for gripping food and a slightly broader second end that is held against said lip of the innermost hollow tubular sections when said telescoping chopstick is extended and fitting within said innermost hollow tubular section when collapsed; and a cap that snugly fits onto the end of the broadest hollow tubular section for closing said broadest tubular section and holding the other tubular and tip sections with said broadest tubular section.

17. The device of claim 11 further comprising:

a securing means attached to said back face plate for securing said device to a surface.

18. The device of claim 17 wherein said securing means is a magnet.

19. The device of claim 11 wherein said front face is clear.

* * * * *